US009271553B2

(12) United States Patent
Ponx

(10) Patent No.: US 9,271,553 B2
(45) Date of Patent: Mar. 1, 2016

(54) BEACH/POOL BAG WITH HIDDEN COMPARTMENT

(71) Applicant: David A. Ponx, Pueblo, CO (US)

(72) Inventor: David A. Ponx, Pueblo, CO (US)

( * ) Notice: Subject to any disclaimer, the term of this patent is extended or adjusted under 35 U.S.C. 154(b) by 73 days.

(21) Appl. No.: 14/145,388

(22) Filed: Dec. 31, 2013

(65) Prior Publication Data

US 2015/0181994 A1 Jul. 2, 2015

(51) Int. Cl.
*A45C 3/06* (2006.01)
*A45C 3/10* (2006.01)

(52) U.S. Cl.
CPC ..... *A45C 3/10* (2013.01)

(58) Field of Classification Search
CPC ..... A45C 3/06; A45C 3/00; A45C 13/06; A45C 13/08; A45C 13/10; F25D 3/08
USPC ..... 150/118, 100, 106, 103, 113, 152; 190/100, 103, 107, 108, 111, 112; 206/549, 579; 383/24, 38, 39, 40, 76
See application file for complete search history.

(56) References Cited

U.S. PATENT DOCUMENTS 2,705,063 A * 3/1955 Torrent ..... A45C 13/02 190/111
2,801,666 A * 8/1957 Steele ..... A45C 11/20 150/113
3,759,356 A * 9/1973 Bostick ..... A45C 7/00 190/111
4,506,769 A * 3/1985 Franco ..... A45C 3/00 16/DIG. 40
4,756,394 A * 7/1988 Cohen ..... A45C 5/14 150/111
4,941,603 A * 7/1990 Creamer ..... A45F 3/04 150/109
5,209,279 A * 5/1993 Wilson ..... A45C 3/06 150/111
5,307,908 A * 5/1994 Shyr ..... A45C 7/0068 190/103
5,873,504 A * 2/1999 Farmer ..... A45C 3/00 150/113
6,000,509 A * 12/1999 Chisholm ..... A45C 13/02 150/113
6,015,072 A * 1/2000 Young ..... A45C 7/0063 190/103
6,213,268 B1 * 4/2001 Dancyger ..... A45C 13/02 150/113
6,253,570 B1 * 7/2001 Lustig ..... A45C 15/00 62/125
7,900,757 B2 * 3/2011 Sisitsky ..... A45C 1/024 150/113
8,267,130 B1 * 9/2012 Sinnett ..... A45C 3/001 150/112
2004/0108179 A1 * 6/2004 Scicluna ..... A45C 5/06 190/109
2012/0328220 A1 12/2012 Kayata
2013/0020160 A1 * 1/2013 Mangano ..... A45C 5/14 190/18 A
2013/0105048 A1 5/2013 Cornelius
2013/0216158 A1 8/2013 Meldeau et al.

* cited by examiner

*Primary Examiner* — Fenn Mathew
*Assistant Examiner* — Cynthia Collado
(74) *Attorney, Agent, or Firm* — Richard C. Litman

(57) ABSTRACT

The beach/pool bag with hidden compartment has a hidden compartment positioned at the bottom of the bag that is equipped with a zipper-closable access. A flap is provided to cover and conceal the zipper, thereby presenting a false bottom and disguising the existence of the compartment underneath.

5 Claims, 4 Drawing Sheets

BEACH/POOL BAG WITH HIDDEN COMPARTMENT

BACKGROUND OF THE INVENTION

1. Field of the Invention

The present invention generally relates to receptacles, and particularly to a beach/pool bag with a hidden compartment located therein.

2. Description of the Related Art

Spending fun time at the swimming pool or beach often requires the need for a plethora of ancillary items. Sunblock, comb, brush, extra pool/beach apparel, towels, first aid kit, etc. are just some of the items that are usually transported to the selected venue. The ubiquitous beach bag is the popular receptacle of choice to transport and house the array of above-mentioned items. Aside from the usual items, the beach bag may also be employed to transport refreshing beverages and house valuables, such as cash, jewelry and personal identification items (driver's license, medical insurance cards, etc.). However, keeping the beverages hot or cold and the valuables hidden from sight presents a problem for the beach bag user. A beach bag that could serve as a repository for the usual beach/pool paraphernalia and also provide a hidden insulated compartment for housing beverages and/or valuables would certainly be a welcome asset to a user. Thus, a beach/pool bag with a hidden compartment solving the aforementioned problems is desired.

SUMMARY OF THE INVENTION

The beach/pool bag with hidden compartment is a beach or pool bag having a compartment positioned at the bottom of the bag, the compartment having a zipper-closable access. A flap is provided to cover and conceal the zipper, thereby presenting a false bottom and disguising the existence of a compartment underneath. A hidden zipper-closable access to the compartment is also provided on the exterior surface of the bag.

Accordingly, the invention presents a beach bag having a conventional appearance, but incorporating a hidden compartment therein. The compartment is insulated and can be utilized to conceal personal valuables therein and to also house beverage containers. The bag also includes a cable for attaching the bag to a stationary object. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
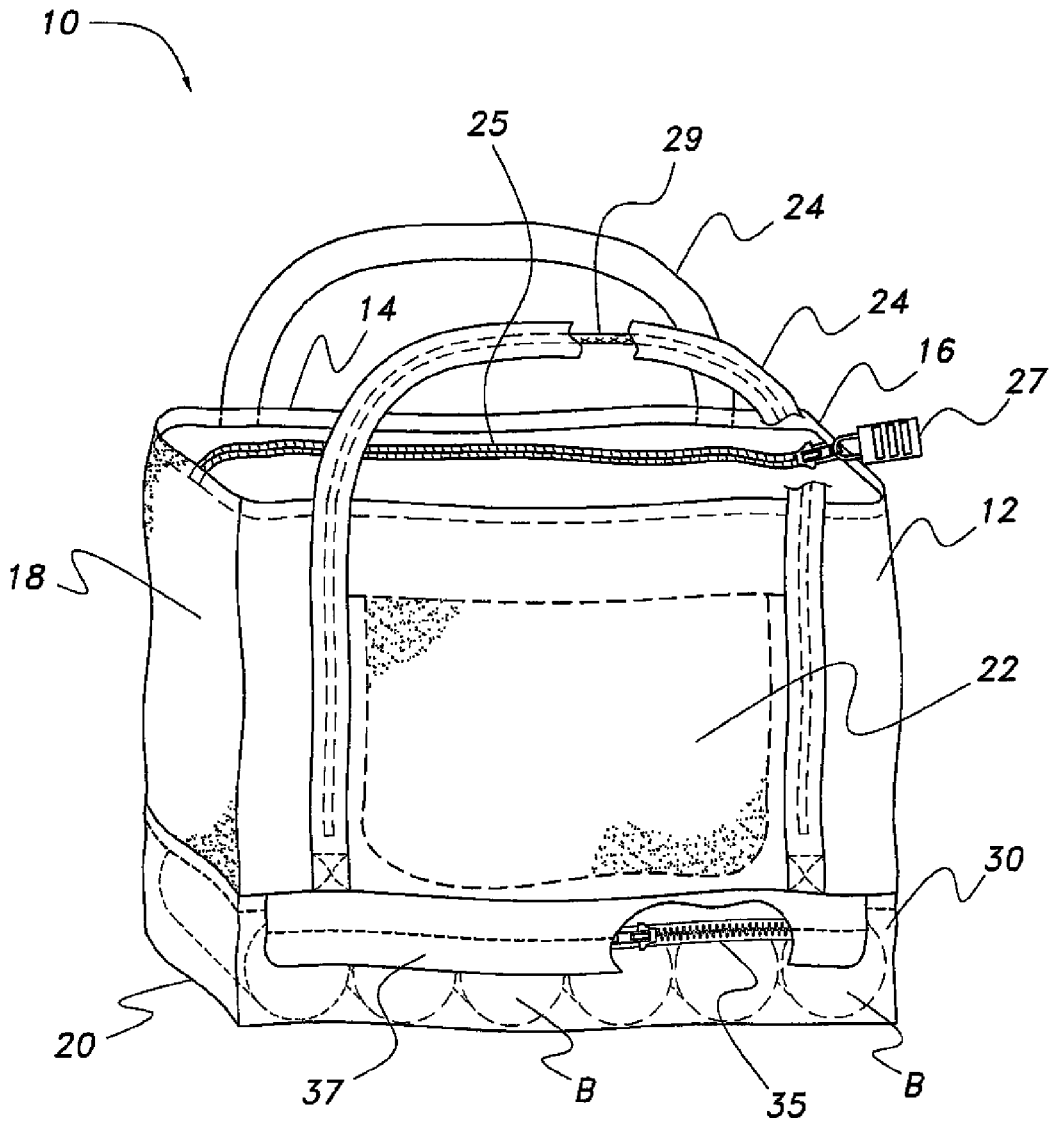
FIG. 1 is a perspective view of a beach/pool bag with hidden compartment according to the present invention.
Figure 2:
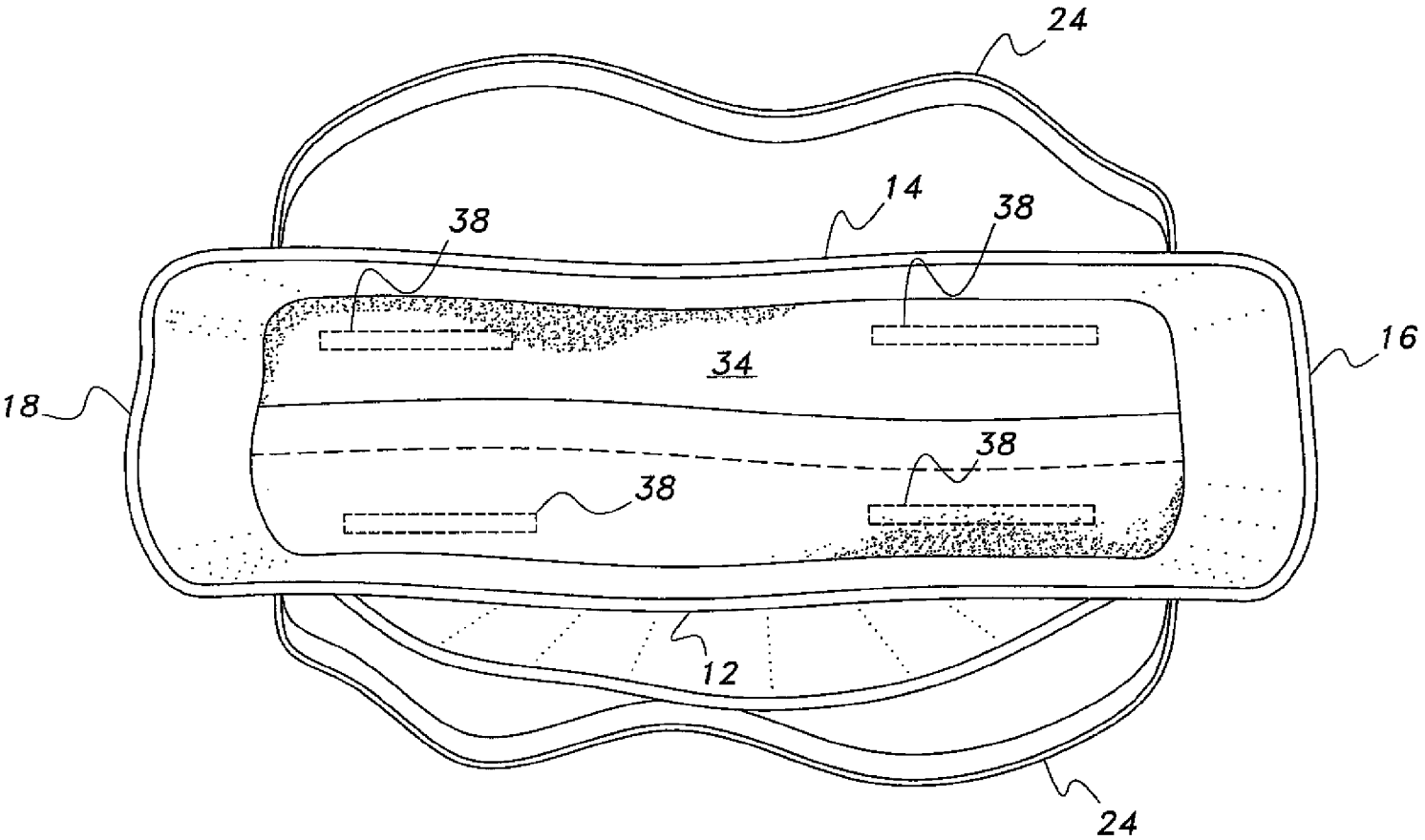
FIG. 2 is a top view of the beach/pool bag of FIG. 1, showing the inside of the bag with the zipper access to the hidden compartment closed and hidden from view.
Figure 3:
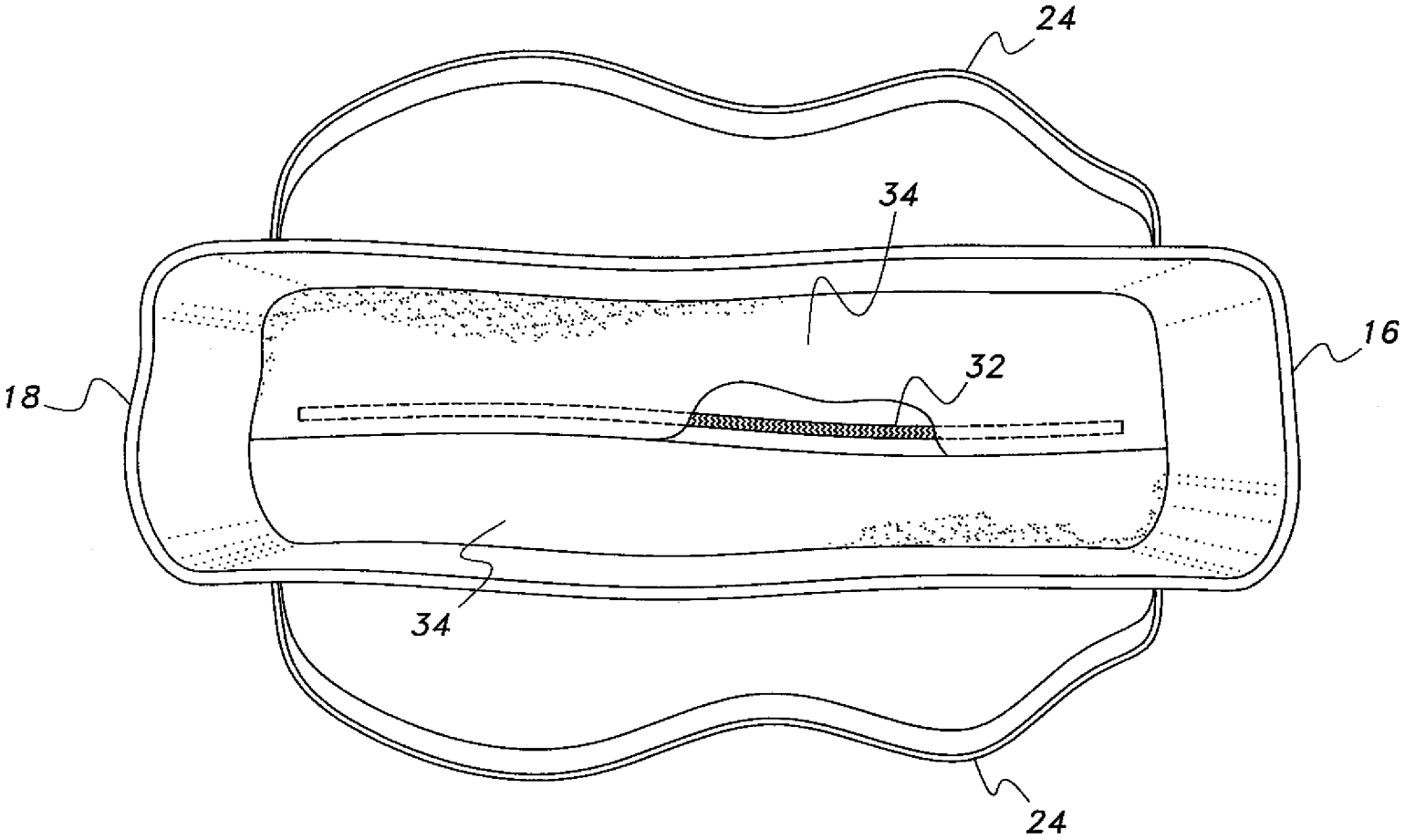
FIG. 3 is a top view of the beach/pool bag of FIG. 2 with a portion of the flap member broken away to show the zipper access to the hidden compartment.
Figure 4:
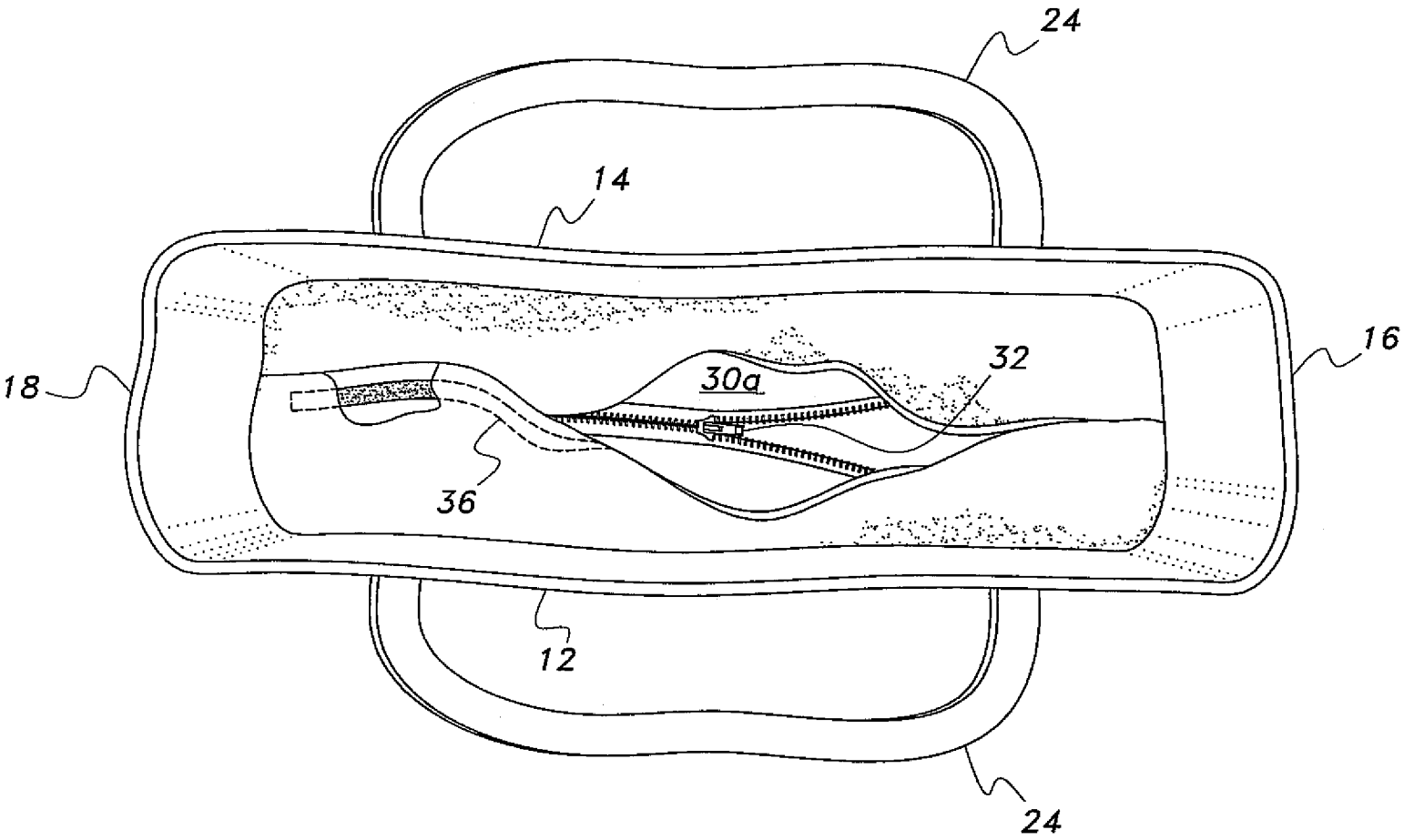
FIG. 4 is a top view of the beach/pool bag of FIG. 3, showing the hidden compartment partially open.

Referring to FIGS. 1-4, the beach/pool bag with hidden compartment is generally indicated at 10. The bag 10 conventionally comprises respective front and rear walls 12, 14 sidewalls 16, 18 and bottom wall 20 attached at their edges to form an open-top first compartment. Optionally, the stiff sidewalls 16, 18 could be eliminated to leave a flexible upper portion of the bag 10 if it is desired to conserve material. One or more pouches 22 (only one is shown) are positioned on the exterior surfaces of the front and rear walls 12, 14 to house items therein. Although not illustrated, additional pouches could be provided for the exterior surfaces of the sidewalls 16, 18, if desired. Carrying straps 24 or a drawstring are attached to the bag 10 in a suitable manner. A zipper 25 is employed to close the open top of the bag. The zipper may be secured with a lock 27. The lock may take the form of a built in type and/or combination type if desired. The walls of the bag 10 may be fabricated from any suitable material (canvas, leather, nylon, vinyl, etc.). A security cable 29 having a lock thereon (not shown) is hidden inside one of the carrying straps 24 and is removable therefrom. The security cable provides a means to attach the bag to a stationary object such as a beach chair or the like to prevent easy theft of the bag. The cable may be fabricated from any suitable material that is flexible and not easily broken or cut.

A second compartment 30 is positioned at the bottom of bag 10. The second compartment 30 is fabricated from thermal insulation material or incorporates thermal insulation into the walls and is of a size to house several conventional beverage containers B therein. The second compartment 30 has a top surface 30*a* fashioned with an opening that is closed with a zipper 32. A movable flap 34 is designed to overlie the top surface 30*a* of the compartment 30 for reasons explained below. One side of the flap 34 is permanently attached to the top surface 30*a*. Hook and loop fasteners 36 are employed to removably attach the other side of the flap 34 to the top surface 30*a* of the compartment 30. With the flap 34 in place, anyone unfamiliar with the bag 10 would assume that the flap 34 is the inside bottom wall of the bag 10, and thus be unaware that a compartment exists beneath the flap 34. The compartment 30 may also be accessed from the exterior of bag 10. This is accomplished by providing an opening on at least one exterior, side surface of the bag to access the compartment 30. A zipper 35 is operable to open and close the opening. The zipper 35 is covered by a movable flap 37, similar to flap 34, which hides the zipper from view. Stiffener or reinforcement members 38 (shown in phantom lines and preferably fabricated from hard plastic) are removably inserted in the compartment 30 along the walls and bottom thereof for extra support, and to allow the bag 10 to stand upright when the compartment 30 is not filled with beverage containers, thereby maintaining the illusion of a bag 10 having no additional compartment at its bottom.

In use, the compartment 30 is unzipped and the desired items are inserted therein. As indicated above, the items may be beverage containers that are to be kept at a temperature range or personal valuables. The zipper 32 (or 35) is manipulated to close the compartment 30. The flaps 34 and/or 37 are arranged over the compartment and attached thereto, thereby concealing the compartment 30 from view.

It is to be understood that the present invention is not limited to the embodiments described above, but encompasses any and all embodiments within the scope of the following claims.

I claim:

1. A beach/pool bag, comprising:

a front wall, a rear wall, a pair of end walls and a bottom wall joined together at respective side edges to form a first compartment, the first compartment having an open top and a lower area adjacent the bottom wall, a lockable fastener selectively closing the open top of the first compartment;

a second compartment fabricated from thermal insulation material, the second compartment being disposed within the first compartment in the lower area contiguous to the bottom wall, the second compartment consists of a top surface and a single opening formed in the top surface providing an access to the second compartment, the second compartment has an external side surface, wherein the external side surface has a single opening therein providing a second access to the second compartment, the second access consisting of:

a zipper mounted in the external side surface for selectively opening and closing the opening in the external side surface; and a movable flap member mounted on the external side surface for selectively overlaying the zipper and hiding the opening in the external side surface;

a second zipper mounted on the top surface for selectively opening and closing the opening in the top surface of the second compartment;

a second movable flap member mounted on the top surface for selectively overlaying the second zipper and hiding the opening in the top surface providing access to the second compartment, the second movable flap member having a first edge and a second edge, the first edge being permanently attached to the top surface, the second edge and the top surface having mating hook and loop fasteners, whereby the second edge is removably attachable to the top surface of the second compartment; and at least one carrying strap attached to one of the walls of the first compartment and a security cable hidden in the at least one carrying strap.

2. The beach/pool bag according to claim 1, further including at least one pouch attached to one of the walls of said first compartment.

3. The beach/pool bag according to claim 1, further including a plurality of stiffener members removably disposed in said second compartment at least along the bottom wall for providing support for said second compartment and thereby allowing the bag to maintain an upright position.

4. The beach/pool bag according to claim 1, further including carrying straps attached to the walls of said first compartment.

5. A beach/pool bag, comprising:

a front wall, a rear wall, a pair of end walls and a bottom wall joined together at respective side edges to form a first compartment, the first compartment having an open top and a lower area adjacent the bottom wall, a lockable fastener selectively closing the open top of the first compartment;

a second compartment, the second compartment being disposed within the first compartment in the lower area contiguous to the bottom wall, the second compartment consists of a top surface and an opening formed in the top surface providing an access to the second compartment, the second compartment has an external side surface, wherein the external side surface has an opening therein providing a second access to the second compartment, the second access consisting of:

a fastener mounted in the external side surface for selectively opening and closing the opening in the external side surface; and a movable flap member mounted on the external side surface for selectively overlaying the fastener and hiding the opening in the external side surface;

a second fastener mounted on the top surface for selectively opening and closing the opening in the top surface of the second compartment;

a second movable flap member mounted on the top surface for selectively overlaying the second fastener and hiding the opening in the top surface providing access to the second compartment, the second movable flap member having a first edge and a second edge, the first edge being permanently attached to the top surface, the second edge and the top surface having mating hook and loop fasteners, whereby the second edge is removably attachable to the top surface of the second compartment; and at least one carrying strap attached to one of the walls of the first compartment and a security cable hidden in the at least one carrying strap.

* * * * *